US006525278B2

(12) United States Patent
Villain et al.

(10) Patent No.: US 6,525,278 B2
(45) Date of Patent: Feb. 25, 2003

(54) KEYBOARD SWITCH ASSEMBLY INCLUDING ACTUATOR MEMBER WITH THREE ACTIVE POSITIONS

(75) Inventors: Jean-Christophe Villain, Colombes (FR); Bertrand Cupif, Antony (FR); Luc Brisson, Puteaux (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/987,250

(22) Filed: Nov. 14, 2001

(65) Prior Publication Data

US 2002/0063045 A1 May 30, 2002

(30) Foreign Application Priority Data

Nov. 30, 2000 (FR) ..... 00 15485

(51) Int. Cl.[7] ..... H01H 25/00; H01H 13/705

(52) U.S. Cl. ..... 200/5 R; 200/6 A

(58) Field of Search ..... 200/1 R, 5 R, 200/5 A, 512–517, 520–573, 314, 315, 341–345, 329–332.2; 235/145 R; 379/433.06, 433.07; 341/22–35

(56) References Cited

U.S. PATENT DOCUMENTS 4,408,103 A * 10/1983 Smith, III ..... 200/6 A
4,687,200 A * 8/1987 Shirai ..... 200/6 A X
4,769,516 A * 9/1988 Allen ..... 200/5 R
4,896,003 A * 1/1990 Hsieh ..... 200/6 A
4,975,547 A * 12/1990 Nakayama et al. ..... 200/5 R
4,992,631 A * 2/1991 Gee ..... 200/5 A
5,086,313 A 2/1992 Misawa ..... 200/5 R
5,349,263 A * 9/1994 Katayama et al. ..... 341/34 X
5,536,911 A 7/1996 Madill ..... 200/6 A
5,668,357 A * 9/1997 Takiguchi et al. ..... 200/5 R
6,047,962 A * 4/2000 Popadiuk ..... 273/119 A
6,157,323 A * 12/2000 Tso et al. ..... 200/5 A X

OTHER PUBLICATIONS

Patent Abstracts of Japan, vol. 1997, No. 12, Dec. 25, 1997 & JP 09 204854 A (NEC Corp.), Aug. 5, 1997.
Patent Abstracts of Japan, vol. 1999, No. 09, Jul. 30, 1999 & JP 11 111120 A (Kokusai Electric Co LTD), Apr. 23, 1999.

* cited by examiner

*Primary Examiner*—J. P. Scott
(74) *Attorney, Agent, or Firm*—Sughrue Mion, PLLC

(57) ABSTRACT

The present invention provides an actuator member of the multifunction key type, in particular of the navigation key type, consisting of a rigid button mounted with limited mobility and a separate detector component having a plurality of active sites. The button has underside formations each intended to come into contact with one of the active sites. Three active sites are disposed at the corners of a triangle, wherein a non-active bearing site is disposed between two of the active sites, alone or in conjunction with the third active site, so as to allow tilting of the button by pivoting on the non-active site toward one of the first two active sites situated on respective sides thereof until the corresponding formation comes into contact with one of the active sites to activate it, for example by compressing it or depressing it.

11 Claims, 2 Drawing Sheets

KEYBOARD SWITCH ASSEMBLY INCLUDING ACTUATOR MEMBER WITH THREE ACTIVE POSITIONS

The present invention relates to actuator members for electronic instruments or devices, especially keys and keypads for data processing or telecommunications devices, and provides a navigator type actuator member and a device with a keypad including at least one such member.

BACKGROUND OF THE INVENTION

Such devices belong in particular to the following group: {fixed or mobile telephone; smart phone; personal digital assistant; desktop, portable or pocket computer; remote controller}.

At present most multifunction key or navigation key actuator members take the form a pre-assembled subassembly mounted on an electronic circuit card 109' underlying the keys 102' of the keypad 109 of the device to ensure secure interconnection and cooperation of the button 102 and the detector active component 103 (see FIGS. 1 and 2).

This has two major drawbacks: the visible parts of the members of all keypads are the same color, which sometimes does not match the other keys and/or the body of the keypad, and the button 102 is not centered or aligned optimally and reliably with the corresponding opening in the housing or envelope of the keypad and does not provide a sealed closure of the opening.

In an attempt to alleviate these drawbacks, it has been proposed to mount the button 102 and active component subassembly 103 in the housing of the keypad 109 and to connect the active component 103 by springs 110 to the electronic circuit card 109' under the keys 102' (see FIGS. 3 and 4).

In this case, it is possible to select the color of the button so that it matches that or those of the housing and the other keys, the subassembly and the other keys being assembled with the housing of the keypad during the same fabrication step. Also, the only possibility of misalignment is between the subassembly and the card, and therefore invisible to the user.

However, it is difficult or even impossible to choose a button the same color as the other keys, since the buttons and the keys are not generally produced by the same manufacturer.

What is more, this solution leads to a special and irksome operation of preassembling the subassembly and necessitates special physical connections between the housing of the keypad and the electronic circuit card.

OBJECTS AND SUMMARY OF THE INVENTION

One object of the present invention is to alleviate the aforementioned drawbacks by proposing an actuator member of the type previously cited whose button and active component can be manufactured separately, necessitate no subsequent physical assembly, and are not connected by any physical connection, all this being achieved with guaranteed high reliability of operation and total discrimination between the various commands that can be given by means of said member.

To this end, the present invention provides an actuator member of the multifunction key type, in particular of the navigation key type, consisting of a rigid button mounted with limited mobility in translation and in rotation, and a separate detector component having a plurality of active sites, for example pressure-sensitive sites, said button having on its underside formations each intended to come into contact with a respective one of said active sites of said component as a function of the location, intensity and/or direction of pressure exerted by a user on the button, the member including three active sites which are disposed at the corners of a triangle and wherein a non-active bearing site disposed between a first two of said active sites, alone or in conjunction with the third site, authorizes tilting of said button by pivoting on said non-active site toward one of said first two active sites situated on respective sides thereof until the corresponding formation comes into contact with one of said active sites to activate it, for example by compressing it or depressing it.

BRIEF DESCRIPTION OF THE DRAWINGS

The invention will be better understood from the following description, which relates to one preferred embodiment of the invention, is given by way of non-limiting example, and is explained with reference to the accompanying diagrammatic drawings, in which.

MORE DETAILED DESCRIPTION

Figure 1:
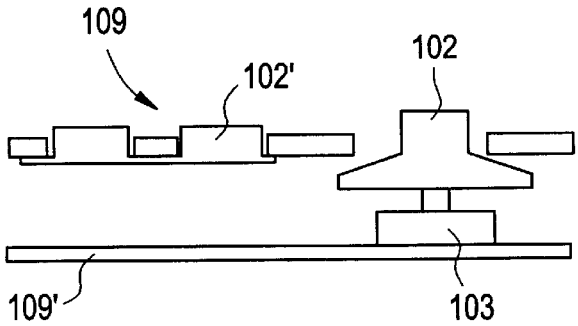
FIG. 1 PRIOR ART
FIGS. 1 and 2 illustrate an example of the prior art.
Figure 2:
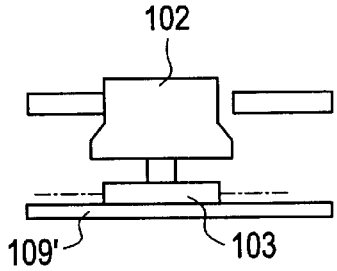
FIG. 2 PRIOR ART
Figure 3:
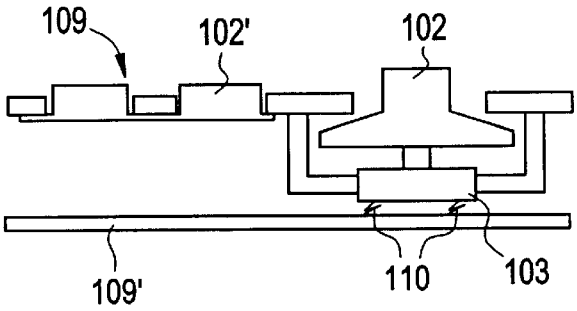
FIG. 3 PRIOR ART
FIGS. 3 and 4 illustrate another example of the prior art.
Figure 4:
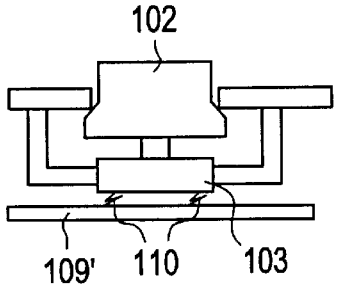
FIG. 4 PRIOR ART

As shown in FIGS. 5 and 7 of the accompanying drawings, the actuator member 1 is of the multifunction key type, in particular of the navigation key type, and consists of a rigid button 2, mounted with limited mobility in translation and in rotation, and a separate detector component 3 comprising a plurality of pressure-sensitive active sites 4, 4' and 5, said button 2 having on its underside formations 6, 6' and 6" each intended to come into contact with one of the active sites 4, 4' and 5 of said component, as a function of the location, intensity and/or direction of pressure exerted by the user on the button 2.

In accordance with the invention, the detector component 3 of said member 1 has three active sites 4, 4', 5 disposed at the corners of a triangle, and between a first two of said sites 4, 4' there is a non-active bearing site 7 enabling, on its own or in conjunction with the third site 5, tilting of said button 2 by pivoting on said inactive site 7 towards one of said first two active sites 4, 4', which are situated on respective opposite sides thereof, until the corresponding formation 6 or 6' comes into contact with one of said two active sites 4, 4' to activate it, preferably by compressing it or by depressing it, although other modes of activation are also possible.

Thanks to these dispositions, it is therefore possible to produce the member 1 by associating two components that are fabricated independently and cooperate only because of a given relative disposition during assembly of the device receiving them, without any physical connection between the two components.

Further, a non-active or inactive bearing site 7 provides a physical constraint that prevents simultaneous activation of the first two sites 4 and 4'.

According to one feature of the invention, facilitating manipulation of the member 1, the non-active site 7 defines with the third active site 5 a pivot edge or an imaginary rotation axis for the button 2. Thus it is not necessary to apply a precise pressure to the button 2 to activate the site 4 or 4', all that is important being which side is pressed.

As shown in FIG. 6 of the accompanying drawings, the three sites 4, 4', 5 are preferably disposed at the corners of an isosceles triangle and the non-active bearing site 7 is centered on the base of said triangle extending between the first two active sites 4 and 4'.

Furthermore, in an advantageous embodiment of the invention based on pressure-sensitive active sites 4, 4', and 5, the values of the activation threshold pressures for the first two active sites 4 and 4' are substantially identical and the value of the activation threshold pressure for the third site 5 is advantageously significantly greater than, preferably at least twice, that of said first two sites 4 and 4'.

This latter disposition establishes a second level of discrimination between the first two active sites 4 and 4', on the one hand, and the third active site 5, on the other hand. In conjunction with the physical discrimination provided by the non-active or inactive bearing site 7 previously mentioned, this makes simultaneous activation by the user of two of the three active sites previously mentioned impossible, regardless of the direction, point of application and magnitude of the pressure applied to the button 2.

Figure 5A:
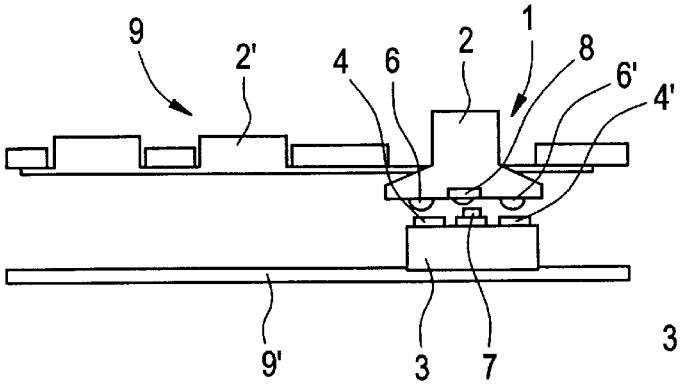
FIGS. 5A and 5B are views in lateral elevation and partly in section in two perpendicular directions of a portion of a keypad including a preferred embodiment of an actuator member according to the invention.
Figure 5B:
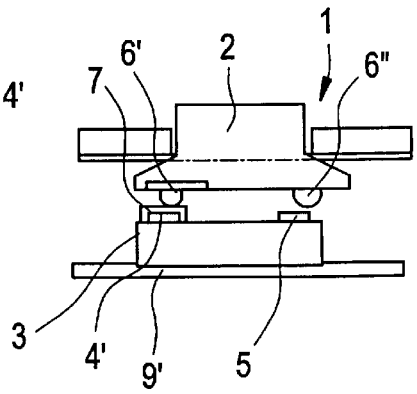

In a preferred embodiment of the invention shown in FIGS. 5A and 5B of the accompanying drawings in particular, the inactive bearing site 7 consists in a formation protruding relative to the first two active sites 4 and 4', authorizing tilting of the button 2 in the direction of the third active site 5 until the corresponding formation 6" on the underside of the button 2 comes into contact with the latter to activate it, preferably by compressing it or by depressing it, by pivoting with an appropriate formation 8 on the underside bearing on the contact area of the site 7.

Instead of this, the inactive bearing site 7 could equally consist of a non-protruding bearing area of the component 3 cooperating with a formation 8 higher than the other formations 6, 6' and 6" on the underside of the button 2 and thereby constituting a preferential bearing point of the button 2 on the component 3, preventing, as in the first embodiment previously mentioned, simultaneous bearing of the formations 6 and 6' on the facing first two sites 4 and 4' and securing the latter if a centered high pressure is applied to activate the third site 5.

As shown in FIGS. 5 to 7 of the accompanying drawings, the contact areas of the formations 6, 6', 6" and/or the contact areas of the active sites 4, 4', 5 and of the inactive site 7 are surface contact areas.

The surface contact areas of the active sites 4, 4' and 5 and/or the facing formations 6, 6' and 6" ensure reliable operation of the actuator member 1 by their capacity to compensate any lateral longitudinal misalignment between the button 2 and the component 3 (see FIGS. 5A and 5B, 7A, 7B and 7C).

In FIGS. 5A and 5B, the button 2 and the component 3 are intentionally offset relative to each other, as in the situation of poor assembly, to illustrate the compensation capacity previously mentioned.

Although the contact areas between the formations 6, 6', 6" and 8 and the sites 4, 4', 5 and 7 can take various forms, for example plane forms (FIG. 7), to facilitate manipulation of the button 2 by the user it may be advantageous for at least the contact between the inactive bearing site 7 and the corresponding facing formation 8 on the underside of the button 2 to constitute a point contact or virtually a point contact, the contact area of said site 7 or of said formation 8 being a surface contact area.

To make the button 2 even more comfortable to manipulate, in particular to activate the sites 4 and 4' by pivoting the button on the sites 7 and 5, the contact between the third active site 5 and the corresponding formation 6" on the underside of the button 2 also constitutes a point contact or virtually a point contact, the contacts between the first two active sites 4 and 4' and the corresponding formations 6 and 6' on the button 2 possibly also constituting a point contact or virtually a point contact.

In a preferred embodiment of the invention, shown in FIGS. 5A and 5B of the accompanying drawings, the formations 6, 6', 6" and 8 are hemispherical or dome-shaped protruding formations and the active sites 4, 4', 5 can also be protruding formations, the cumulative heights of the formations 6, 6', 6" and the respective facing active sites 4, 4', 5 being substantially identical and equal to the cumulative height of the inactive bearing site 7 and the corresponding formation 8 on the underside of the button 2.

Of course, instead of this, the sites 4, 41', 5 and 7 could equally well consist of dome-shaped structures and the contact areas of the formations 6, 6', 6" and 8 could be surface contact areas, or both types of structure previously mentioned could be a combination of said sites and said formations.

According to one feature of the invention, the first two active sites 4 and 4' correspond to commands or functions that are opposed, for example scrolling or moving in opposite directions in a menu or a table, and the third active site 5 corresponds to a validation or confirmation command or function.

Figure 6A:
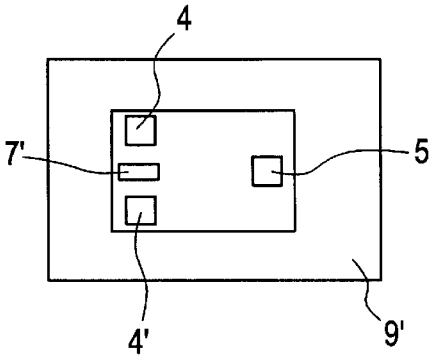
FIGS. 6A and 6B are respectively plan and perspective views of a detector component forming part of the actuator member shown in FIG. 5, and FIGS. 7A, 7B and 7C are lateral elevation views similar to those of FIG. 5 showing, in relation to a different embodiment of the invention, the reaction of the actuator member according to the invention as a function of the application of different pressures by a user.
Figure 6B:
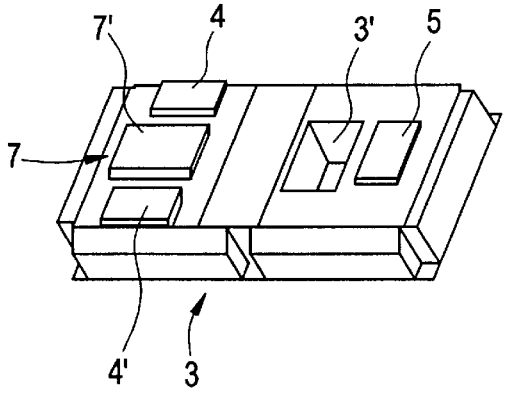

The pressure detector component 3 is preferably of one-piece construction and includes an open cavity in the direction of the button or a through-opening 3' to accommodate a component for illuminating the button 2 by transmission, the button being made from a transparent material and mounted by insertion molding (see FIGS. 6A and 6B).

FIG. 7 shows various cases of activation or non-activation of the sites 4, 4' and 5 as a function of the magnitude and direction of the pressure exerted by the user.

Figure 7A:
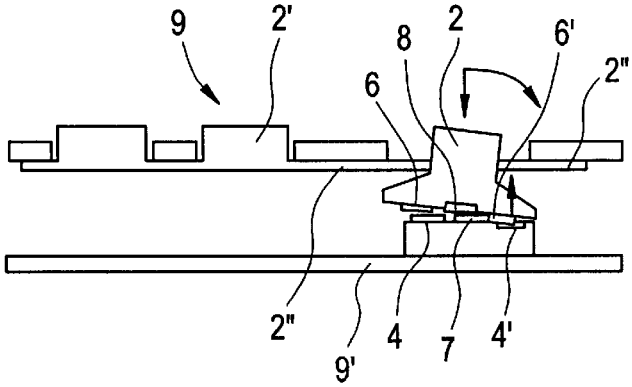
Figure 7B:
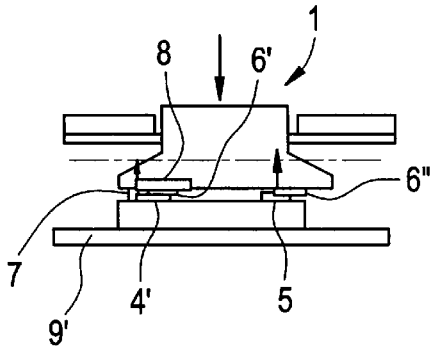
Figure 7C:
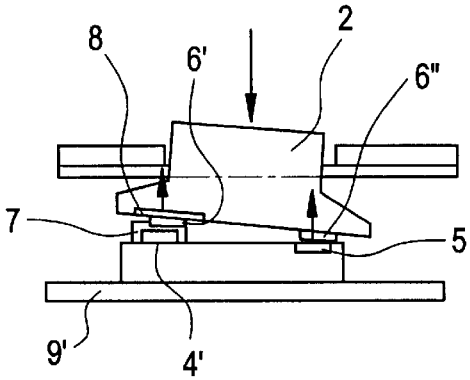

In FIGS. 7A and 7C, the direction, impact area and magnitude of the forces applied are adapted to activate the site 4', and site 5.

In FIG. 7B, the magnitude of the applied force is insufficient to activate the site 5.

The present invention also provides a device including a keypad 9 providing a plurality of keys 2' and at least one multifunction key, for example a navigation key for selecting a plurality of functions displayed on display means of the device, wherein the multifunction key is an actuator member 1 as described above.

The button 2 is advantageously made in one piece with the other keys 2' by insertion molding during fabrication of the keypad 9 and the detector component 3 is premounted on an electronic circuit card disposed under the keys 2' of the keypad 9 after assembly thereof.

The facility for limited movement of the button 2 can be provided by the resilience of the material of a film or plate 2" connecting the various keys 2' and the button 2.

The button 2 can instead and equally well be separate from the keypad 9 but retain the advantage of receiving a front face shipped with the layer and an appropriate color navigation button 2.

Of course, the invention is not limited to the embodiment described and shown in the accompanying drawings. Modifications are possible without departing from the scope of protection of the invention, in particular from the point of view of the construction of the various components or substituting technical equivalents.

What is claimed is:

1. An actuator member of the multifunction key type, in particular of the navigation key type, comprising:

a rigid button, mounted with limited mobility in rotation, and a separate detector component having a plurality of active sites, wherein said button has underside formations each intended to come into contact with a respective one of said active sites as a function of the location, magnitude and/or direction of pressure exerted by a user on the button, wherein the plurality of active sites includes three active sites which are disposed in a triangle formation, so as to be disposed at the corners of the triangle formation, and wherein a non-active bearing site is disposed between a first two of said active sites as viewed along one leg of the triangle formation, and wherein said button tilts by pivoting on said non-active site toward one of said first two active sites situated on respective sides thereof until one of the underside formations comes into contact with one of said active sites to activate said one of said active sites by depressing said one of said active sites, and wherein activation threshold pressure values for the first two active sites are substantially identical, while an activation threshold pressure value for the third active site is at least twice that of said first two active sites.

2. An actuator member according to claim 1, wherein the non-active bearing site and the third active site define a pivot edge for the button, the triangle formation is formed as an isosceles triangle, and the non-active bearing site is centered on the base of said triangle so as to be disposed between the first two active sites.

3. An actuator member according to claim 1, wherein the non-active bearing site protrudes relative to the first two active sites, allowing tilting of the button in the direction of the third active site until one of the underside formations of the button comes into contact with one of the first two active sites to activate said one of the first two active sites by depressing said one of the first two active sits, by pivoting with corresponding one of said underside formations bearing on a contact area of said one of the first two active sites.

4. An actuator member according to claim 1, wherein contact areas of the underside formations and/or contact areas of the active sites and the non-active bearing site are surface contact areas.

5. A actuator member according to claim 1, wherein contact between the non-active bearing site and the corresponding underside formation is substantially a point contact, the contact area of said non-active bearing site or said underside formation being a surface contact area.

6. An actuator member according to claim 5, wherein the contact between the third active site and the corresponding underside formation is substantially a point contact and the contacts between the first two active sites and the corresponding underside formations are substantially point contacts.

7. An actuator member of the multifunction key type, in particular of the navigation key type, comprising:

a rigid button, mounted with limited mobility in rotation, and a separate detector component having a plurality of active sites, wherein said button has underside formations each intended to come into contact with a respective one of said active sites as a function of the location, magnitude and/or direction of pressure exerted by a user on the button, wherein the plurality of active sites includes three active sites which are disposed in a triangle formation, so as to be disposed at the corners of the triangle formation, and wherein a non-active bearing site is disposed between a first two of said active sites as viewed along one leg of the triangle formation, and wherein said button tilts by pivoting on said non-active site toward one of said first two active sites situated on respective sides thereof until one of the underside formations comes into contact with one of said active sites to activate said one of said active sites by depressing said one of said active sites, and wherein contact between the non-active bearing site and the corresponding underside formation is substantially a point contact, the contact area of said non-active bearing site or said underside formation being a surface contact area, wherein the underside formations are dome-shape protruding formations, the active sites are protruding formations, and the cumulative heights of the underside formations and the respective facing active sites are substantially equal to the cumulative height of the non-active bearing site and the corresponding underside formation.

8. An actuator member of the multifunction key type, in particular of the navigation key type, comprising:

a rigid button, mounted with limited mobility in rotation, and a separate detector component having a plurality of active sites, wherein said button has underside formations each intended to come into contact with a respective one of said active sites as a function of the location, magnitude and/or direction of pressure exerted by a user on the button, wherein the plurality of active sites includes three active sites which are disposed in a triangle formation, so as to be disposed at the corners of the triangle formation, and wherein a non-active bearing site is disposed between a first two of said active sites as viewed along one leg of the triangle formation, and wherein said button tilts by pivoting on said non-active site toward one of said first two active sites situated on respective sides thereof until one of the underside formations comes into contact with one of said active sites to activate said one of said active sites by depressing said one of said active sites, and wherein contact between the non-active bearing site and the corresponding underside formation is substantially a point contact, the contact area of said non-active bearing site or said underside formation being a surface contact area, wherein the first two active sites correspond to opposed commands, and wherein the third active site corresponds to a confirmation command.

9. An actuator member of the multifunction key type, in particular of the navigation key type, comprising:

a rigid button, mounted with limited mobility in rotation, and a separate detector component having a plurality of active sites, wherein said button has underside formations each intended to come into contact with a respective one of said active sites as a function of the location, magnitude and/or direction of pressure exerted by a user on the button, wherein the plurality of active sites includes three active sites which are disposed in a triangle formation, so as to be disposed at the corners of the triangle formation, and wherein a non-active bearing site is disposed between a first two of said active sites as viewed along one leg of the triangle formation, and wherein said button tilts by pivoting on said non-active site toward one of said first two active sites situated on respective sides thereof until one of the underside formations comes into contact with one of said active sites to activate said one of said active sites by depressing said one of said active sites, and wherein contact between the non-active bearing site and the corresponding underside formation is substantially a point contact, the contact area of said non-active bearing site or said underside formation being a surface contact area, wherein the detector component is of one-piece construction and includes an opening facing the button to house a component for illuminating the button by transmission, the button being made from a translucent material.

10. An actuator member according to claim 1, wherein the button is mounted by insertion molding.

11. A device including a keypad including a plurality of keys and at least one multifunction key, for selecting a plurality of functions displayed on display means of said device, wherein the multifunction key includes an actuator member comprising:

a rigid button mounted with limited mobility in rotation; and a separate detector component having three active sites, wherein said button has underside formations each capable of contacting with a respective one of the active sites of said detector component, wherein said active sites are provided in a triangle formation so as to be disposed at the corners of the triangle formation, wherein a non-active bearing site is disposed between the first two of said active sites, when viewed along a leg of the triangle formation, to allow, with the third active site, tilting of said button by pivoting on said non-active site toward one of said first two active sites situated on respective opposite sides thereof until the corresponding underside formation comes into contact with one of said two active sites in order to activate said one of said two active sites, and wherein activation threshold pressure values for the first two active sites are substantially identical, while an activation threshold pressure value for the third active site is at least twice that of said first two active sites.

* * * * *